United States Patent [19]

Jacobson

[11] 4,414,618

[45] Nov. 8, 1983

[54] LAMP SHADE ADJUSTER AND HOLDER

[76] Inventor: Darwin J. Jacobson, P.O. Box 962, Port Angeles, Wash. 98362

[21] Appl. No.: 467,270

[22] Filed: Feb. 17, 1983

Related U.S. Application Data

[63] Continuation of Ser. No. 342,502, Jan. 25, 1982, abandoned.

[51] Int. Cl.[3] ..... F21V 17/00

[52] U.S. Cl. ..... 362/417; 362/282; 362/358; 362/413; 362/414; 362/418; 362/430; 362/449

[58] Field of Search ..... 362/358, 417, 282, 414, 362/413, 418, 430, 449

[56] References Cited

U.S. PATENT DOCUMENTS

| | | | |
|---|---|---|---|
| 3,016,455 | 1/1962 | Goldfine | 362/449 X |
| 3,281,589 | 10/1966 | Cronan | 362/449 X |
| 3,281,590 | 10/1966 | Truax et al. | 362/449 X |
| 3,309,515 | 7/1967 | Fanshire | 362/449 X |
| 4,244,013 | 1/1981 | Wotowiec | 362/260 |

*Primary Examiner*—Stephen J. Lechert, Jr.
*Attorney, Agent, or Firm*—Seed and Berry

[57] ABSTRACT

A lamp shade adjuster and holder consisting of two parts; a bracket having an upper horizontal flat surface with a centrally located hold to receive a lamp harp stud, laterally at the peripheral of said flat surface, two diametrically opposed bracket arms, said arms extending downwardly, each arm with a channel portion that engages the upward outer portion of a lamp shade harp. Disposed on said horizontal flat surface is a substantially flat plate having a centrally located hole to receive a lamp harp stud, and a triad of equally spaced adjustable screw means located near the peripheral of said plate. A lamp shade hub is disposed on said plate, and the adjustment of the triad screw means adjusted to level said lamp shade. A standard lamp shade finial is tightened on the lamp harp stud, locking the level lamp shade in place.

6 Claims, 3 Drawing Figures

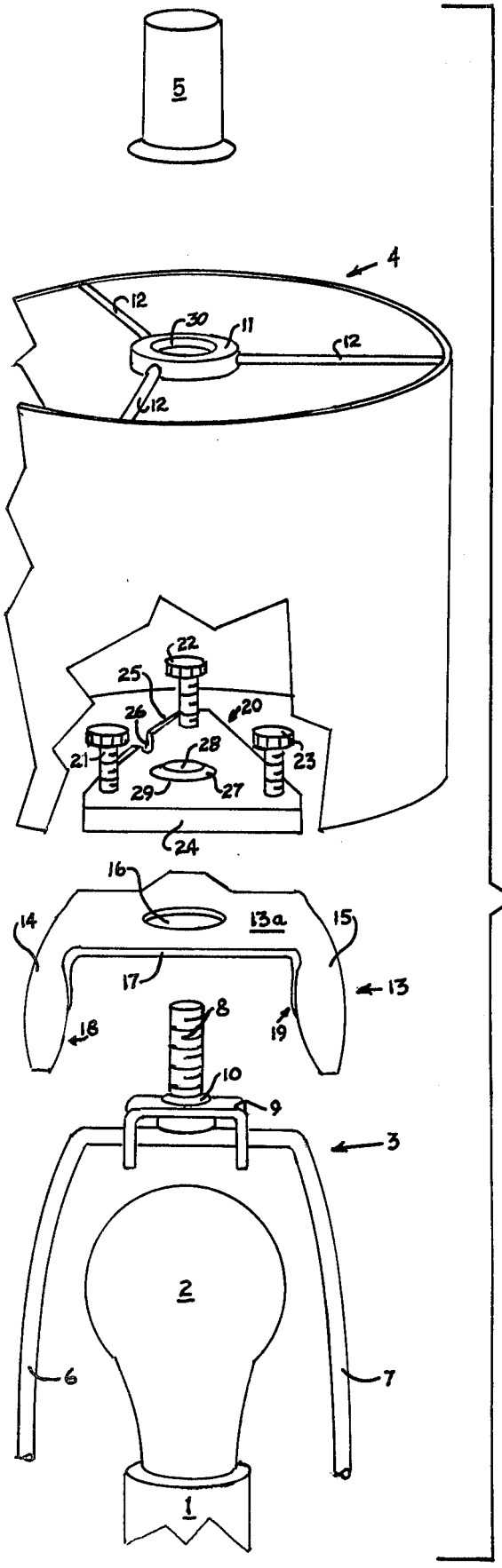
FIG. 1
FIG. 2
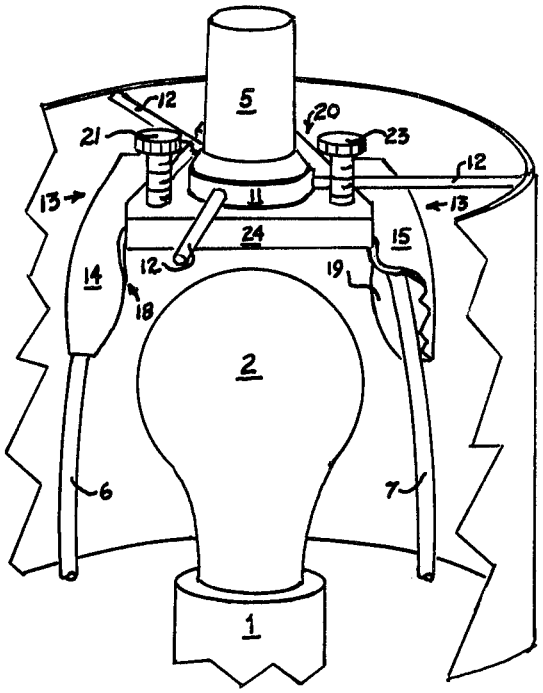
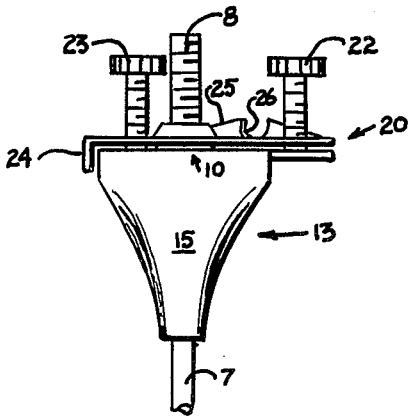
FIG. 3

LAMP SHADE ADJUSTER AND HOLDER

This application is a continuation of patent application Ser. No. 342,502, filed Jan 25, 1982, now abandoned.

FIELD OF INVENTION

This invention relates to table and floor lamps, and more specifically, to means of adjusting, leveling and holding a lamp shade on the lamp harp.

BACKGROUND OF INVENTION

Prior Art discloses attempts to provide means to adjust, level and hold lamp shades in a properly oriented position. U.S. Pat. No. 3,281,589, each radial arm of the lamp shade is modified to provide for an adjustment by means of a telescoping mechanism, but does not address the problem of holding or locking the lamp shade in adjusted position on the harp. In U.S. Pat. No. 3,016,455, the hub of the shade is modified to provide for horizontal adjustment by means of a ball joint mechanism, but does not address the problem of holding or locking the harp stud in a vertical position on the harp to prevent the entire assembly from inadvertently tilting.

SUMMARY OF INVENTION

It is the purpose of the present invention to provide a lamp shade adjuster that is a simple add-on to standard floor and table lamps. Another object is to provide a device that will adjust a shade to level and thereafter keep that adjustment. Another object is to provide a device that will resist the pivotal movement of a lamp harp stud bracket on the harp. Another object is to provide a device that will not permit the lamp shade hub to revolve on the harp stud. Another object is to provide a device that will not become maladjusted when lamp shade is removed and later reinstalled. Another object is to provide the foregoing device through simple manufacturing means and the use of some off-the-shelf parts.

Briefly, stated, these objects are obtained by a combination of two main components. The first component consisting of a bracket, said bracket being essentially flat at the upward portion and having a central opening therein to fit over a lamp harp stud, and having diametrically opposed, downwardly extending legs for firmly contacting the lamp harp legs, thereby resisting revolving of the lamp harp stud bracket on the harp. A second component, in the form of a plate provided with means of adjusting on a horizontal plane, the angle of said plate and the first component, over which it is positioned and rests. This second component has a downward lip portion to overlap a straight edge portion of said first component to resist relative turning of the two components, and an upward notched lip to prevent turning of the lamp shade hub relative to said second component. The first and second components could be formed of sheet metal, or injection molded. Common, off-the-shelf screws are means of adjustment.

BRIEF DESCRIPTION OF DRAWINGS

FIG. 1 is a fragmentary exploded front view showing a fragmented lamp socket, harp and shade, and a lamp bulb and finial. The structure of the present invention is shown in the order of assembly.

FIG. 2 is a similar view, wherein the structure of the present invention, with a portion of one bracket leg broken away to show fit over harp leg, is shown assembled with the lamp shade installed and the finial threaded onto the harp stud.

FIG. 3 is a side view of the present invention installed on a harp, a lower portion of the harp being broken away.

DESCRIPTION OF THE PRESENT INVENTION

Referring to FIG. 1, there is illustrated the portion of a standard lamp assembly consisting of the upper portion of a socket (1), a bulb (2), a harp (3), a shade (4). In more detail, a harp left leg (6), a harp right leg (7), a harp stud (8), a harp stud bracket (9), a harp stud swedging mound (10), a lamp shade hub (11) and a lamp shade radial arms (12).

My lamp shade adjuster and holder consists of the following parts: A harp bracket (13), consisting of downwardly extending diametrically opposed legs (14) and (15), having substantially flat portion (13*a*), and a centrally located opening (16) for coaxial fit with swedged mound (10) and stud (8), and a straight edge portion (17). The legs (14) and (15) incorporate inwardly facing channel portions (18) and (19) for gripping harp legs (6) and (7). An adjustable place (20) having screws (21, (22) and (23) threaded through and arranged in a substantially triangular pattern for adjusting said plate angularly on a horizontal plane to the plane of the essentially flat top (13*a*) of the harp bracket (13), and integral to said plate, a downwardly extending lip (24) for overlapping the straight edge (17) of harp bracket (13) and an upwardly extending lips (25), and a notch (26) cut in said lip to receive one of the radial arms (12). Centrally located in plate (20), is a cupped portion (27) with a central opening (28) for coaxially encompassing stud (8). The outside base area (29) of the cupped portion (27) furnishes the seating area for the lower inside edge (30) of hub (11).

Referring to FIGS. 1, 2 and 3, with shade (4) removed from harp (3), harp bracket (13) is installed on harp with opening (16) coaxial to harp stud (8) and swedged mound (10). The under surface of flat portion (13*a*) is flush with the upper surface of bracket (9), and channel portions (18) and (19) encompass harp legs (6) and (7). The screws (21), (22) and (23) are carried in plate (20) and are adjusted so that lower ends of the threaded shank do not protrude below plate (20). Plate (20) is then installed so that opening (28) is coaxial with stud (8) and the undersurface of said plate (20) is flush with the upper surface of flat portion (13*a*) of bracket (13), and with lip (24) overlapping straight edge portion (17). The lamp shade (4) is then installed with the under side of the hub (11) flush with the top surface of the plate (20) and with the hub opening (30) coaxial to cupped portion (27) and with one radial arm (12) engaged in notch (26). To level shade (4), screws (21), (22) and (23) provide means of adjusting angle of shade (4) by changing angle of plate (20) in relation to the angle of upper surface (13*a*) of harp bracket (13). Finial (5) is replaced on stud (8) and tightened. The adjustment is now complete and the shade securely affixed in level position. The harp bracket legs (14) and (15) lock stud (8) in a fixed vertical position, as lip (24) overlaps straight edge (17), assuring resistance to horizontal turning on the axis of stud (8). A radial arm (12), being engaged in notch (26), prevents shade (4) from turning on the axis of stud (8), and finial (5), tightened securely on hub (11), applies pressure to those screws (21), (22) or (23) contacting the upper surface of harp bracket (13), essentially locking the screws in adjusted position.

Thereafter, the lamp shade can be removed and reinstalled without disrupting the adjustment.

While the above description contains many specificities, these should not be construed as limitations on the scope of the invention, but rather as an examplification of one preferred embodiment thereof. Many other variations are possible; for example, the harp bracket part could carry inverted adjustment screws that would adjust upward against the adjustable plate for leveling. In still another embodiment, the harp bracket could carry upwardly extending lip and notch, and the adjustable plate could be a circular plate turntable on the harp stud, having a wedging means integral where the plate could be turned on the same vertical axis as that of the stud to bring the wedging means at the radial line extending from the stud to the lowest point at the peripheral of the lamp shade, thence the wedge moved, to move the plate angularly to bring the shade to level position. Accordingly, the scope of the invention should be determined not by the embodiment illustrated, but by the appended claims and their legal equivalents.

What is claimed is:

1. A lampshade adjuster and holder comprising:

(a) a lamp harp having a stud bracket affixed to an upper portion of the harp, said stud bracket carrying a substantially vertically extending harp stud;

(b) a harp bracket having an opening to encompass the harp stud; and (c) a plate having an opening to encompass the harp stud, resting on the harp bracket, and including means for adjusting the mutual angular relationship of the plate and harp bracket.

2. A lamp shade adjuster and holder according to claim 1, wherein:

(a) the harp bracket has integral, diametrically opposed, downwardly extending legs for engaging opposing side legs of the lamp harp;

(b) the plate has a downwardly extending lip portion, an upwardly extending notched lip for engaging a lamp shade radial arm, and at least one screw as a portion of the means for adjusting.

3. A lamp shade adjuster and holder comprising:

(a) a harp bracket including a flat upper portion having a straight edge, an opening in said flat portion to encompass a harp stud, and downwardly extending legs at diametrically opposed sides of said flat portion, wherein a lower section of each leg includes an inwardly facing channel to encompass a correspondingly opposed harp leg;

(b) a substantially flat plate having a downwardly extending lip for engaging the straight edge of the harp bracket, an upwardly extending notched lip for engaging a horizontally disposed lamp shade radial arm, a centrally located mounded portion, an opening for encompassing a harp stud, and screw means for adjusting the horizontal angular relationship between the harp bracket and plate.

4. A lamp shade adjuster and holder for a lamp harp, comprising:

(a) a first reference member attachable to the harp around a harp stud;

(b) a second reference member attachable to the lamp shade; and (c) means for adjusting the mutual angular relationship of the first and second reference members, wherein the means connects between the reference members.

5. The lamp shade adjuster of claim 4 wherein the means for adjusting includes at least one screw.

6. The lamp shade adjuster of claim 5 wherein the first reference member includes a reference edge and wherein the second reference member includes a lip which engages and is guided by the reference edge when the angular relationship is adjusted.

* * * * *